US005823695A

United States Patent [19]

Bock

[11] Patent Number: 5,823,695

[45] Date of Patent: Oct. 20, 1998

[54] IMAGING APPARATUS INCLUDING A GUIDE FOR GUIDING A RECEIVER MEDIUM THERETHROUGH WITH REDUCED FRICTION AND A GUIDE ASSEMBLY METHOD THEREFOR

[75] Inventor: John A. Bock, Rochester, N.Y.

[73] Assignee: Eastman Kodak Company, Rochester, N.Y.

[21] Appl. No.: 833,856

[22] Filed: Apr. 10, 1997

[51] Int. Cl.[6] ..... B41J 13/10

[52] U.S. Cl. ..... 400/642; 226/196; 347/104; 101/416.1

[58] Field of Search ..... 400/642, 643, 400/248, 644, 645, 646, 624, 625; 101/232, 416.1, 417, 419, 420, 421; 347/104, 105; 271/226; 226/196, 198, 199

[56] References Cited

U.S. PATENT DOCUMENTS

| | | | |
|---|---|---|---|
| 3,912,254 | 10/1975 | Woodruff | 271/64 |
| 3,941,290 | 3/1976 | Bunning | 226/83 |
| 3,965,292 | 6/1976 | Costello et al. | 178/42 |
| 4,083,556 | 4/1978 | Schilling et al. | 271/204 |
| 4,430,012 | 2/1984 | Kooy et al. | 400/616.1 |
| 4,614,287 | 9/1986 | Ueno et al. | 226/74 |
| 5,048,987 | 9/1991 | Golden | 400/613.1 |
| 5,176,458 | 1/1993 | Wirth | 400/120 |
| 5,549,400 | 8/1996 | Tang et al. | 400/236 |

*Primary Examiner*—Christopher A. Bennett
*Attorney, Agent, or Firm*—Walter S. Stevens

[57] ABSTRACT

Imaging apparatus including a guide for guiding a receiver medium therethrough with reduced friction and a guide assembly method therefor. The guide includes mounting portions adapted to be received by mounting locations precisely positioned in a support frame capable of supporting the guide. The mounting portions must precisely mate with the mounting locations so that the guide is properly mounted on the frame during assembly of the imaging apparatus. In this regard, the guide is formed of a flexible material having a relatively low value of Young's modulus of elasticity, so that the guide can be flexed in order to manipulate the guide into position for mating engagement of the mounting portions with the mounting locations. Moreover, the guide is made of a material having a low coefficient of sliding friction for sliding of receiver medium therealong, so that the receiver medium is neither scratched by the guide nor sticks to the guide to cause "jamming" of the apparatus by the receiver medium.

9 Claims, 5 Drawing Sheets

IMAGING APPARATUS INCLUDING A GUIDE FOR GUIDING A RECEIVER MEDIUM THERETHROUGH WITH REDUCED FRICTION AND A GUIDE ASSEMBLY METHOD THEREFOR

FIELD OF THE INVENTION

This invention generally relates to imaging apparatus and assembly methods pertaining thereto and, more particularly, relates to an imaging apparatus including a guide for guiding a receiver medium therethrough with reduced friction and a guide assembly method therefor.

BACKGROUND OF THE INVENTION

In a color thermal imaging apparatus, a print is made by successively transferring color dyes from respective dye patches of a dye donor web onto a receiver medium, such as coated paper or transparency. The dye donor web is disposed between the receiver medium and a print head comprising a plurality of resistive heating elements. When an individual heating element is energized, the radiative heat therefrom causes the dye from the dye donor web to transfer to the receiver medium to form an image on the receiver medium.

In order to produce an image on the receiver medium, the receiver medium is first fed from a receiver medium supply tray. In this regard, a sheet of receiver medium is "picked" from the supply tray by a rotating "picker roller", which engages the receiver medium and transports it to a guide configured to guide the receiver medium toward the print head. After encountering the guide, the receiver medium advances along the guide and thence into a gap formed between the print head and a platen roller disposed adjacent the print head. The print head then moves toward the platen roller, thereby pressing the dye donor web and the receiver medium against the platen roller to form a sandwich-like structure for thermal printing of the image onto the receiver medium.

Prior art guides, such as, for example, disclosed in U.S. Pat. No. 5,176,458 are typically formed of metal, such as stainless steel. These stainless steel members are inherently rigid and stiff at room temperature as evinced by their relatively high value of Young's modulus of elasticity of approximately $30\times10^6$ pounds per square inch at about 75 degrees Fahrenheit. Of course, Young's modulus of elasticity is a constant for a given material and is a measure of its stiffness and thus indicates the ability of the material to resist deflection when loaded, for a given cross-section and at a given temperature. The higher the value of Young's modulus of elasticity, the greater the stiffness of the material. Such prior art guides are usually suspended between parallel support frames in the printer and may have relatively rough marginal edges even after deburring.

Although the typical guide is made of stainless steel, it must nonetheless be further polished before deployment in the printer so that its coefficient of friction is low enough to allow the receiver medium to glide therealong without sticking and scratching of the receiver medium. Sticking of the receiver medium may cause the receiver medium to "jam" in the printer mechanism and stop moving along the guide. Moreover, scratching of the receiver medium will provide an unacceptable print. To avoid sticking and scratching, the stainless steel guide is "mirror" polished so that, after polishing, the coefficient of sliding friction of the receiver medium on the stainless steel guide is approximately 0.8 $\mu$. Although polishing the guide solves the above mentioned problems, such polishing of the guide is a time-consuming additional step in the manufacturing process which leads to increased manufacturing costs. Therefore, a problem in the art is increased manufacturing costs caused by attempts to ameliorate sticking and scratching of the receiver medium on the guide.

Moreover, the rigid stainless steel guide mentioned hereinabove typically includes a plurality of projections configured to be matingly received in respective ones of a plurality of relatively small apertures formed in the support frames supporting the guide. However, it has been observed that close tolerances required to properly fit the projections into the apertures in combination with the relative stiffness of the stainless steel guide make it difficult to manipulate the guide so as to first align and then insert the projections into the relatively small apertures. Precise alignment of the projections with their respective apertures in the frames may require several attempts by the assembler of the printer before successful alignment and insertion into the apertures is obtained. The assembly process precludes assembling the frames to the guide rather than assembling the guide to the frames. Therefore, another problem in the art is the increased manufacturing cost required to assemble the guide to the frames.

The previously mentioned U.S. Pat. No. 5,176,458, titled "Multiple Position Thermal Printer Head Mechanism Which Is Disturbance Insensitive" issued Jan. 5, 1993 in the name of Henry G. Wirth, discloses a device wherein a sheet of receiver medium moves forward into a receiver guide where it follows a curved path toward a gap between a print head assembly and a platen assembly. The receiver guide is connected to a main printer structure. However, this patent does not appear to address the problem of increased manufacturing costs due to attempts to ameliorate sticking and scratching of the receiver medium on the guide and the problem of increased manufacturing costs required to assemble the guide to the main printer structure.

Therefore, what has long been needed is an imaging apparatus including a guide for guiding a receiver medium therethrough with reduced friction and a guide assembly method therefor.

SUMMARY OF THE INVENTION

The invention resides in an imaging apparatus adapted to guide a receiver medium therethrough comprising a frame defining a mounting location thereon; and a guide supported by the frame, the guide defining an axis therethrough and having a mounting portion thereof adapted to be received by the mounting location, the guide being flexible about the axis for bringing the mounting portion into alignment with the mounting location.

An object of the present invention is to provide an imaging apparatus including a guide for guiding a receiver medium therethrough with reduced friction and a cost-effective guide assembly method therefor.

A feature of the present invention is the provision of a guide member having a reduced coefficient of friction.

Another feature of the present invention is the provision of a flexible guide member.

An advantage of the present invention is that use thereof reduces manufacturing costs.

Another advantage of the present invention is that scratching of the receiver medium is avoided.

Still another advantage of the present invention is that probability of the receiver medium "jamming" in the imaging apparatus is reduced.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented hereinbelow, reference is made to the accompanying drawings, in which.

DETAILED DESCRIPTION OF THE INVENTION

Figure 1:
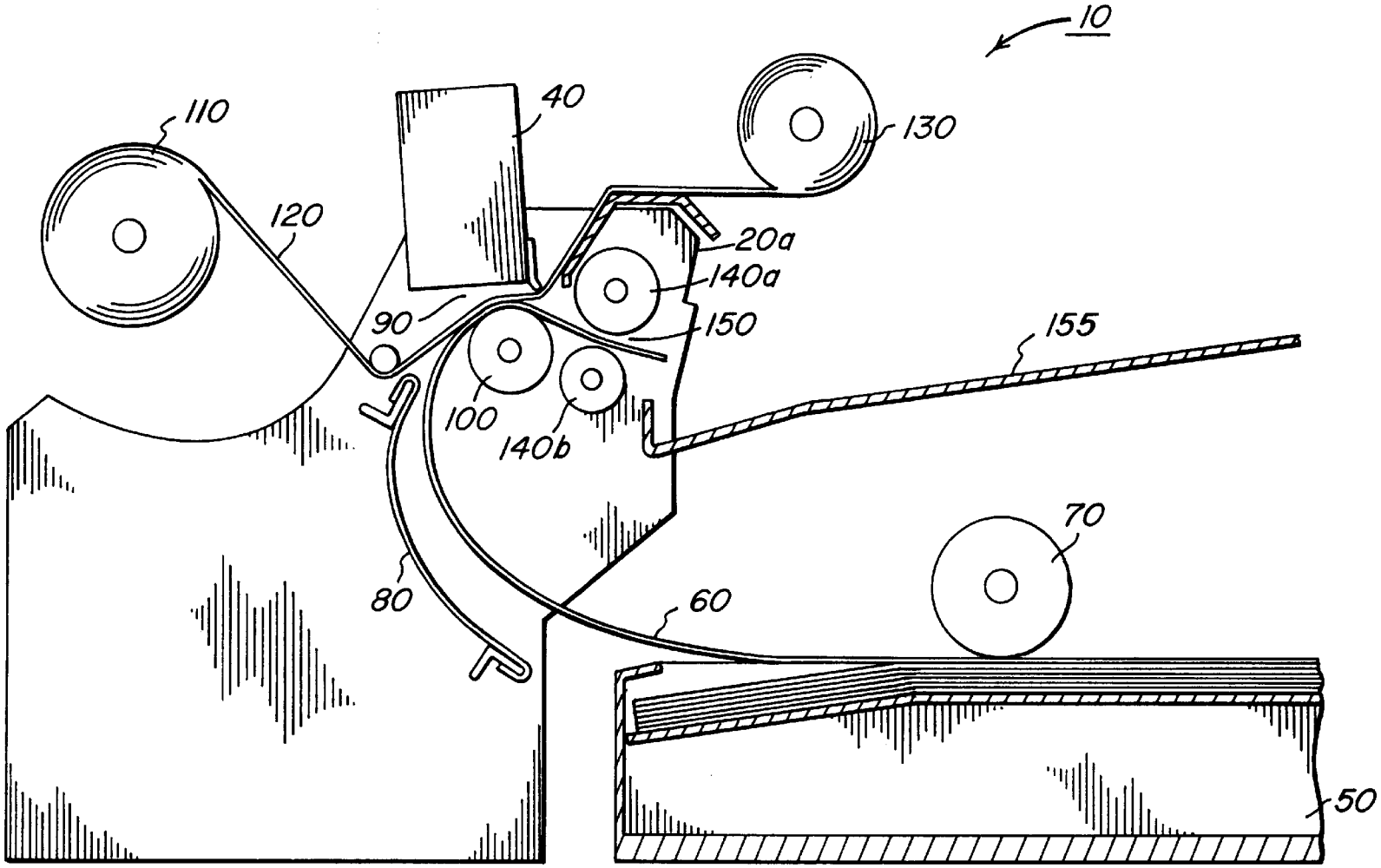
FIG. 1 is a view in elevation of an imaging apparatus, with parts removed for clarity, showing a support frame and a guide member connected to the support frame, this view also showing a receiver medium being guided along the guide member.
Figure 2:
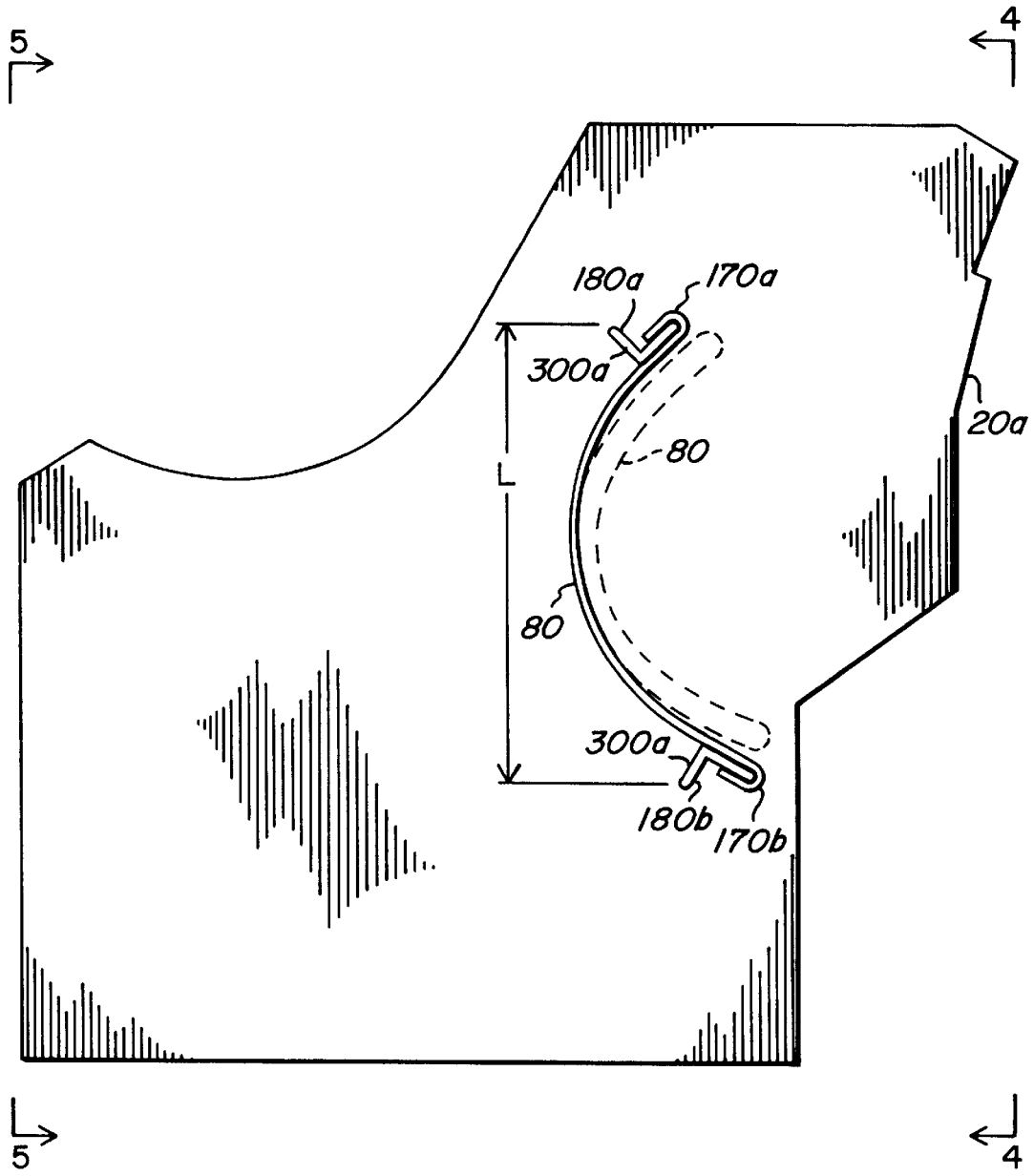
FIG. 2 is a view in elevation of the support frame and the guide member connected thereto.
Figure 3:
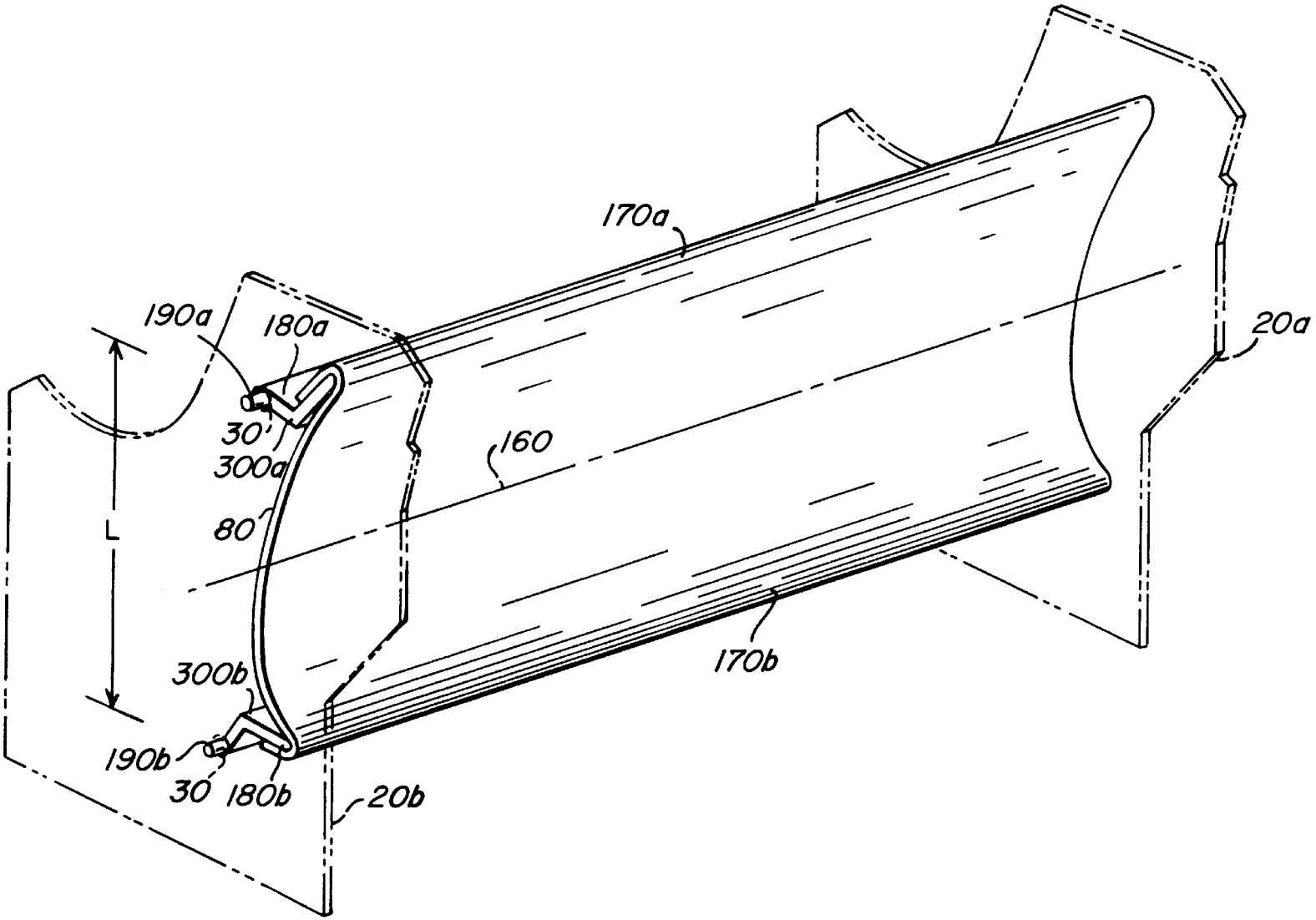
FIG. 3 is a view in perspective of the guide member suspended between a pair of parallel support frames.
Figure 4:
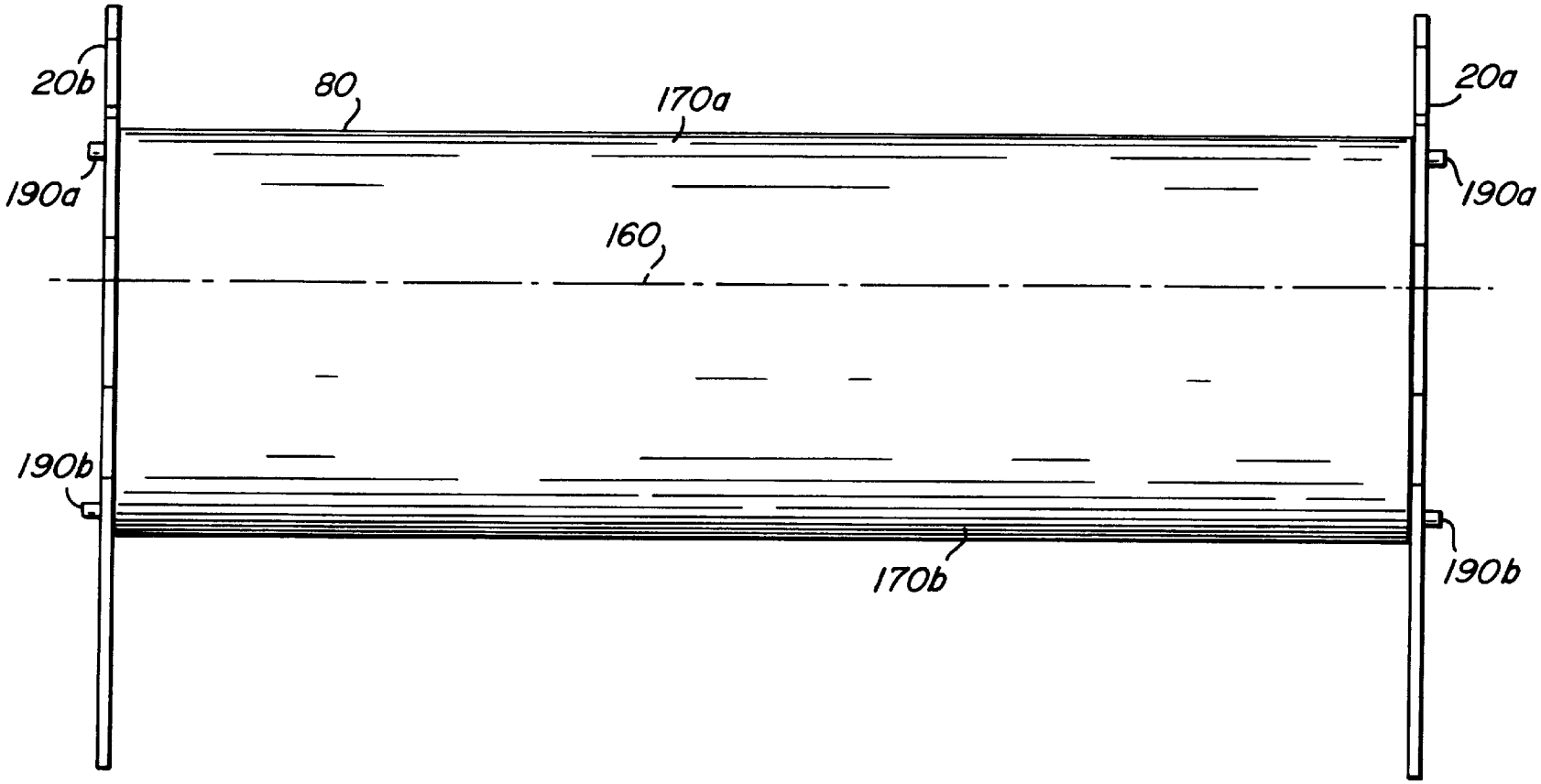
FIG. 4 is a view along section line 4—4 of FIG. 2.
Figure 5:
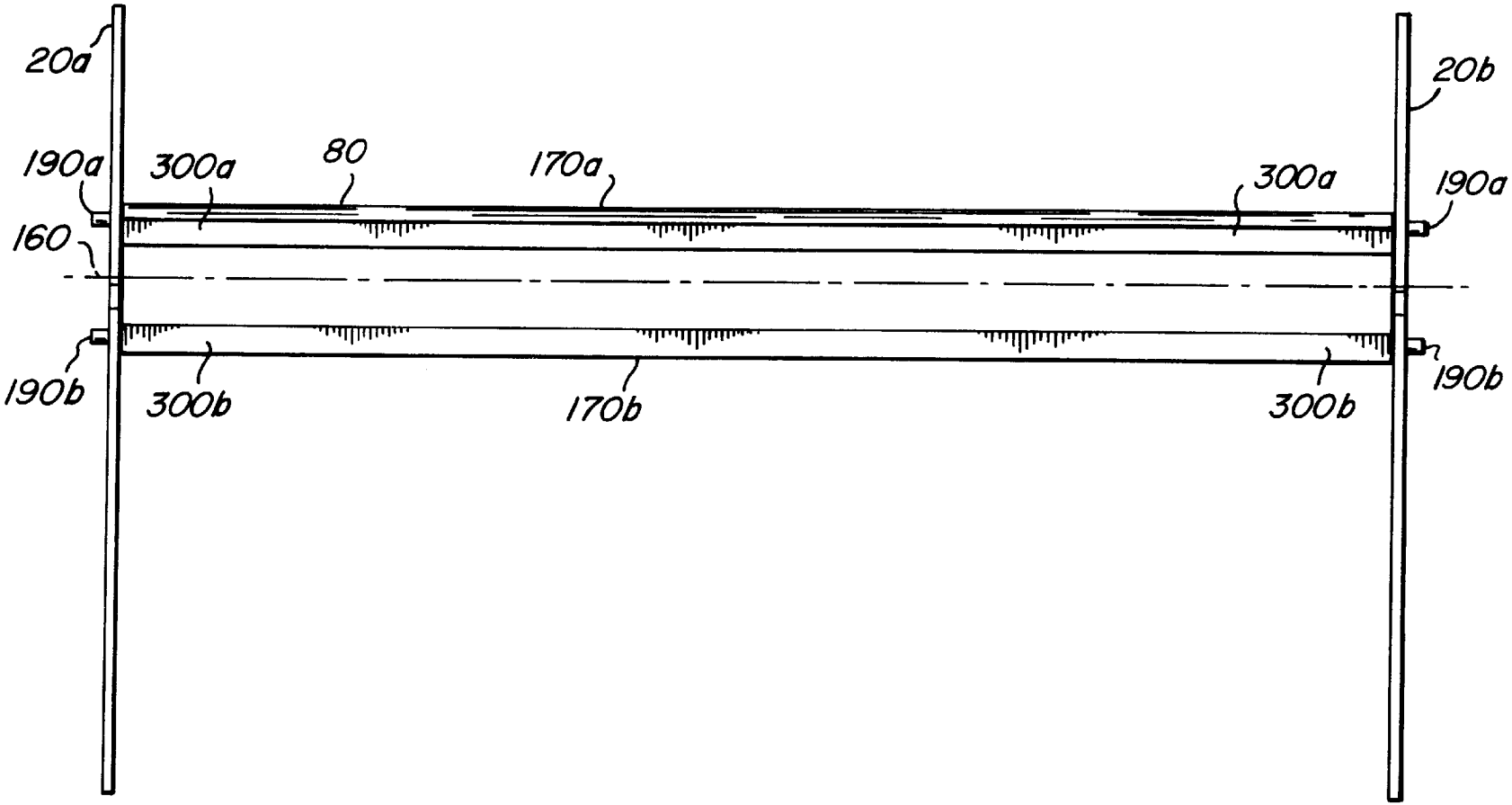
FIG. 5 is a view along section line 5—5 of FIG. 2.

Referring to FIGS. 1, 2 and 3, there is shown an imaging apparatus, generally referred to as 10, with parts removed for clarity. In the preferred embodiment of the invention, imaging apparatus 10 is a color thermal printer and comprises a pair of parallel spaced-apart support frames 20*a*/20*b* having a plurality of apertures 30 therethrough for reasons disclosed hereinbelow. Apertures 30 are precisely machined through frames 20*a*/20*b* in order to adhere to precisely defined and predetermined distances between them. Apparatus 10 also comprises a print head 40 connected to at least one of frames 20*a*/20*b*, so that print head 40 is suitably supported thereby. A receiver medium supply tray 50 associated with print head 40 holds a supply of a receiver medium 60 therein, which receiver medium 60 may be cut sheets of coated paper or cut sheets of transparency. A rotatable "picker roller" 70 is disposed near tray 50 and is adapted to engage receiver medium 60 to remove receiver medium 60 from tray 50.

Again referring to FIGS. 1, 2 and 3, as receiver medium 60 is removed from tray 50, it is intercepted by a single guide member 80, which guides receiver medium 60 into a gap 90 defined between print head 40 and a platen roller 100. As described more fully hereinbelow, guide member 80 is configured so that sticking and scratching of receiver medium 60 by guide member 80 is avoided and so that assembly of guide member 80 to frames 20*a*/20*b* is made easier during manufacture of apparatus 10. A dye donor supply spool 110 having a supply of dye donor ribbon 120 wound thereabout is provided for supplying donor ribbon 120 to gap 90. In addition, a dye donor take-up spool 130 is also provided for taking-up of donor ribbon 120 as donor ribbon 120 is unwound from about supply spool 110 and passes through gap 90. In this manner, dye donor ribbon 120 extends from supply spool 110, through gap 90, and thence to take-up spool 130. A receiver medium transport mechanism, such as a pair of spaced-apart motorized rollers 140*a*/140*b*, engage receiver medium 60 to assist in feeding receiver medium 60 through gap 90. In this regard, rollers 140*a*/140*b* define a nip 150 for receiving receiver medium 60 therebetween, which rollers 140*a*/140*b* are adapted to close nip 150 in order that rollers 140*a*/140*b* can engage receiver medium 60. After passing through nip 150, receiver medium 60 is deposited into an output tray 155 for retrieval by an operator of apparatus 10.

Referring yet again to FIGS. 1, 2 and 3, during operation of apparatus 10, receiver medium 60 is "picked" from supply tray 50 by picker roller 70 and transported to guide member 80. Receiver medium 60 advances along guide member 80 and thence into gap 90 which is defined between print head 40 and platen roller 100. As receiver medium 60 advances into gap 90, print head 40 moves toward platen roller 100 to press dye donor ribbon 120 and receiver medium 60 against platen roller 100 in order to form a sandwich-like structure, as shown. As the sandwich-like structure is formed, heat from thermal print head 40 causes dye in dye donor ribbon 120 to transfer to receiver medium 60 in order to print an image on receiver medium 60.

However, it is desirable that sticking of receiver medium 60 on guide member 80 be avoided in order to avoid "jamming" apparatus 10 with receiver medium 60. Jamming apparatus 10 with receiver medium 60 occurs when receiver medium 60 sticks on guide member 80 to block and inhibit further feeding of receiver medium 60 from supply tray 50. In addition, it is desirable that scratching of receiver medium 60 on guide member 80 be avoided in order to obtain a visually acceptable image on receiver medium 60. Moreover, it is desirable that assembling guide member 80 to frames 20*a*/20*b* be time-efficient to reduce manufacturing costs.

Therefore, referring to FIGS. 1, 2, 3, 4 and 5, there is shown the previously mentioned guide member 80 configured so that sticking and scratching of receiver medium 60 on guide member 80 is avoided and so that assembly of guide member 80 to frames 20*a*/20*b* is made easier during manufacturing of apparatus 10. In this regard, guide member 80 has a generally arcuate shape in transverse cross-section and is preferably formed of a material having a predetermined coefficient of sliding friction sufficient to allow receiver medium 60 to freely slide along guide member 80 without sticking. More specifically, guide member 80 preferably has a coefficient of sliding friction less than 0.8, which is the coefficient of sliding friction for polished stainless steel of which prior art guides are made. In this regard, guide member 80 is preferably formed of a polymer, such as acetal, nylon, polyethylene, "TEFLON" (Trademark of DuPont de Nemours, Inc.), or the like. In the preferred embodiment, "TEFLON", which has a coefficient of sliding friction of 0.04, is used. Guide member 80 may be generally rectangularly-shaped and sized to be interposed between frames 20*a*/20*b*, which were previously caused to be disposed in apparatus 10 to await fitting of guide member 80 thereto. Rectangularly-shaped guide member 80 defines a longitudinal axis 160 extending centrally along the length thereof and includes a pair of rounded parallel edges 170*a*/170*b*. The rounded configuration of edges 170*a*/170*b* of guide member 80 inhibits scratching of receiver medium 60 as receiver medium 60 is intercepted and then guided along a curvilinear guide path defined by guide member 80. In addition, the material forming guide member 80 is the previously mentioned polymer having an inherently smooth surface which also inhibits scratching of receiver medium 60.

Still referring to FIGS. 1, 2, 3, 4 and 5, guide member 80 is capable of flexing about axis 160 (see FIGS. 2 and 3) for reasons provided presently. In this regard, guide member 80 has a predetermined thickness in transverse cross-section of approximately 0.015 inch and is preferably formed of the previously mentioned polymer, so that guide member 80 is suitably flexible. More generally, guide member 80 is preferably formed of a material having a relatively low (i.e., compared to prior art stainless steel guides) Young's modulus of elasticity so that guide member 80 is substantially less stiff than prior art guides. In this regard, in the preferred embodiment of the invention, guide member 80 has a Young's modulus of elasticity of between 586 pounds per square inch and approximately 620 pounds per square inch at room temperature.

Referring again to FIGS. 1, 2, 3, 4 and 5, guide member 80 includes a pair of preferably rigid and elongate mounting members 180*a*/180*b* attached, such as by a suitable adhesive, along respective ones of edges 170*a*/170*b*. As described more fully presently, mounting members 180*a*/180*b* enable mounting of guide member 80 on frames 20*a*/20*b*. Each of mounting members 180*a*/180*b* has a plurality of projections 190*a*/190*b* outwardly extending from end portions 300*a*/300*b* thereof for engaging respective ones of apertures 30. However, the distance between apertures 30, such as a distance "L" (see FIGS. 2 and 3), are machined to close tolerances to reduce vibration and movement of guide member 80 in frames 20*a*/20*b* during transport and operation of apparatus 10. Excessive vibration and movement of guide member 80 is undesirable because such vibration and movement may lead to misalignment of guide member 80 with supply tray 50. Such misalignment impairs the guiding function of guide member 80. However, the distance between projections 190*a*/190*b* may not precisely equal distance "L" due to routine dimensional variances occurring during manufacture. Such dimensional variances make it difficult and time-consuming to first align and then insert projections 190*a*/190*b* into relatively small apertures 30. Therefore, according to the invention, guide member 80 is flexible about longitudinal axis 160 in order to adjust the distance between projections 190*a*/190*b* so that the distance between projections 190*a*/190*b* precisely equals the distance "L" formed during manufacture of apparatus 10. In this manner, projections 190*a*/190*b* are more easily aligned with and then inserted into apertures 30 during assembly of guide member 80 to frames 20*a*/20*b*.

It is appreciated from the teachings herein, that an advantage of the present invention is that use thereof reduces manufacturing costs. This is so because assembly of guide member 80 to frames 20*a*/20*b* is less time-consuming which in turn is due to the ability of guide member 80 to flex about its longitudinal axis 160. This flexibility of guide member 80 allows the distance between projections 190*a*/190*b* to be adjusted for aligning and then inserting projections 190*a*/190*b* into respective ones of apertures 30.

Another advantage of the present invention is that use thereof reduces manufacturing cost in yet another manner. This is so because the material forming guide member 80 does not require the additional step of polishing. Elimination of this additional manufacturing step reduces manufacturing costs.

Still another advantage of the present invention is that image quality is maintained because receiver medium 60 glides along guide member 80 without scratching of receiver medium 60. This is so because guide member 80 includes rounded edges 170*a*/170*b* without bumps or burrs which might otherwise scratch receiver medium 60 as receiver medium 60 is guided along guide member 80. Moreover, guide member 80 is preferably made of a smooth polymer material which inherently inhibits scratching of receiver medium 60.

Yet another advantage of the present invention is that the probability of receiver medium 60 "jamming" in apparatus 10 is reduced. This is so because guide member 80 is preferably formed of the previously mentioned polymer material having a predetermined coefficient of sliding friction sufficient to allow receiver medium 60 to freely slide therealong without sticking. More specifically, guide member 80 preferably has a coefficient of sliding friction of approximately 0.04, which is a coefficient of sliding friction less than polished stainless steel of which prior art guides are made.

While the invention has been described with particular reference to a preferred embodiment, it will be understood by those skilled in the art that various changes may be made and equivalents may be substituted for elements of the preferred embodiment without departing from the invention. In addition, many modifications may be made to adapt a particular situation and material to a teaching of the invention without departing from the essential teachings of the present invention. For example, although the invention is described with reference to a resistive element thermal printer, the invention is equally adaptable to other image forming devices, such as ink jet printers, copiers, and facsimile machines. As another example, although the invention is described as including a guide member formed of a polymer material, any suitable material may be used which has a coefficient of sliding friction for the receiver medium less than the coefficient of sliding friction of prior art guides (e.g., "mirror" polished stainless steel).

Therefore, what is provided is an imaging apparatus including a guide for guiding a receiver medium therethrough with reduced friction and a guide assembly method therefor.

PARTS LIST

10 . . . imaging apparatus
20*a*/20*b* . . . support frames
30 . . . apertures
40 . . . print head
50 . . . supply tray
60 . . . receiver medium
70 . . . picker roller
80 . . . guide member
90 . . . gap
100 . . . platen roller
110 . . . supply spool
120 . . . dye donor ribbon
130 . . . take-up spool
140*a*/140*b* . . . receiver medium transport mechanism
150 . . . nip
155 . . . output tray
160 . . . longitudinal axis
170*a*/170*b* . . . rounded edges
180*a*/180*b* . . . mounting members
190 . . . projections

What is claimed is:

1. Imaging apparatus adapted to guide a receiver medium therethrough, comprising:

(a) a support frame having a pair of apertures therethrough;

(b) an image-forming unit connected to said frame for forming an image on the receiver medium; and (c) a single elongate and flexible guide connected to said support frame for guiding the receiver medium to said image forming unit, said guide having a predetermined coefficient of sliding friction low enough to allow the receiver medium to freely slide therealong, said guide defining a longitudinal axis therethrough and having a pair of opposed parallel edges thereof extending parallel to the longitudinal axis, said guide including a pair of elongate mounting members attached along respective ones of the edges, each of said mounting members having a projection extending therefrom for engaging respective ones of the apertures, whereby said guide is capable of flexing about the longitudinal axis for bringing the projections into alignment with respective ones of the apertures for assembling said guide to said frame, whereby the the projections are received by respective ones of the apertures as the projections align with the apertures, and whereby said guide assembles to said frame as the projections are received by the apertures.

2. The imaging apparatus of claim 1, wherein the predetermined coefficient of sliding friction is approximately 0.04.

3. The imaging apparatus of claim 1, wherein said guide has a predetermined thickness in transverse cross-section and is formed of a polymer for enhancing flexibility thereof.

4. An imaging apparatus adapted to guide a receiver medium therethrough with reduced friction, comprising:

(a) a pair of spaced-apart parallel support frames, each frame having a plurality of apertures therethrough;

(b) a print head connected to at least one of said frames for forming an image on the receiver medium;

(c) a receiver medium supply tray associated with said print head and holding the receiver medium therein for supplying the receiver medium to said print head;

(d) a single arcuate-shaped guide member interposed between said frames for guiding the receiver medium to said print head, said guide member defining a longitudinal axis therethrough and having a pair of opposed parallel edges thereof extending parallel to the longitudinal axis, said guide member having a predetermined coefficient of sliding friction for the receiver medium and being capable of flexing about the longitudinal axis, said guide member including a pair of elongate mounting members attached along respective ones of the edges for mounting said guide member to said frames, each of said mounting members having a plurality of projections extending therefrom for engaging respective ones of the apertures so that said guide member is supported thereby, whereby said guide member is capable of flexing about the longitudinal axis for assembling said guide member to said frames as said guide member is interposed between said frames and as the projections engage the apertures, and whereby the predetermined coefficient of sliding friction allows the receiver medium to freely slide along said guide member.

5. The imaging apparatus of claim 4, wherein said guide member has a predetermined coefficient of sliding friction of approximately 0.04.

6. The imaging apparatus of claim 4, wherein said guide member has a predetermined thickness in transverse cross-section and is formed of a polymer for enhancing flexibility thereof.

7. A guide assembly method, comprising the steps of:

(a) providing a support frame having a pair of apertures therethrough;

(b) connecting an image-forming unit to the frame for forming an image on a receiver medium;

(c) connecting a single elongate and flexible guide to the frame for guiding the receiver medium along the guide and to the image forming unit, the guide defining a longitudinal axis therethrough and having a pair of opposed parallel edges thereof extending parallel to the longitudinal axis, said guide including a par of elongate mounting members attached along respective ones of the edges, each of the mounting members having a projection extending therefrom for engaging respective ones of the apertures, whereby the guide is capable of flexing about the longitudinal axis for bringing the projections into alignment with respective ones of the apertures for assembling the guide to the frame, said guide having a predetermined coefficient of sliding friction low enough to allow the receiver medium to freely slide therealong;

(d) bringing the projections into alignment with respective ones of the apertures, so that the projections align with the apertures as the guide flexes; and (e) engaging the projections with the apertures as the projections align with the apertures, in order to assemble the guide to the frame as the projections engage the apertures.

8. The assembly method of claim 7, wherein said step of connecting a guide to the frame comprises the step of connecting a guide having a coefficient of sliding friction of approximately 0.04.

9. The assembly method of claim 7, wherein said step of connecting a guide to the frame comprises the step of connecting a guide having a predetermined thickness in transverse cross-section and formed of a polymer for enhancing flexibility about the axis thereof.

* * * * *